US006589614B2

(12) United States Patent
Stubblefield et al.

(10) Patent No.: US 6,589,614 B2
(45) Date of Patent: Jul. 8, 2003

(54) CUSHIONING DEVICE FOR AN ATHLETIC SHOE

(75) Inventors: Jerry Stubblefield, Lake Oswego, OR (US); Tuan Le, Portland, OR (US); Thomas Austin, Wayne, PA (US); Robert L. Peterson, West Linn, OR (US)

(73) Assignee: BMC Players, Wilmington, DE (US)

( * ) Notice: Subject to any disclaimer, the term of this patent is extended or adjusted under 35 U.S.C. 154(b) by 0 days.

(21) Appl. No.: 09/897,631

(22) Filed: Jul. 2, 2001

(65) Prior Publication Data

US 2002/0078595 A1 Jun. 27, 2002

Related U.S. Application Data

(60) Provisional application No. 60/226,451, filed on Aug. 17, 2000.

(51) Int. Cl.[7] ..... B29D 22/02; A43B 13/20

(52) U.S. Cl. ..... 428/34.1; 5/655.3; 36/29; 36/35 B; 36/71

(58) Field of Search ..... 36/29, 35 B, 153, 36/127, 143.71, 144; 5/710, 712, 713, 655.3, 655.5, 648, 651, 645, 706; 438/34.1

(56) References Cited

U.S. PATENT DOCUMENTS

| | | | | | |
|---|---|---|---|---|---|
| 505,873 | A | * | 10/1893 | Bomgardener | 5/421 |
| 3,416,169 | A | * | 12/1968 | Emery | 5/644 |
| 3,503,084 | A | * | 3/1970 | Meinwiesser | 5/630 |
| 3,900,910 | A | * | 8/1975 | Nakata | 5/644 |
| 5,575,088 | A | * | 11/1996 | Allen et al. | 36/28 |
| 5,771,606 | A | * | 6/1998 | Litchfield et al. | 36/29 |
| 6,014,823 | A | * | 1/2000 | Lakic | 36/93 |
| 6,354,020 | B1 | * | 3/2002 | Kimball et al. | 36/29 |
| 6,402,879 | B1 | * | 6/2002 | Tawney et al. | 36/29 |

FOREIGN PATENT DOCUMENTS

EP 472110 * 2/1992

* cited by examiner

*Primary Examiner*—Ted Kavanaugh
(74) *Attorney, Agent, or Firm*—Kenyon & Kenyon

(57) ABSTRACT

A cushioning device that imparts both stability and cushioning to the midsole of an athletic shoe. The cushioning device includes a bladder that has a plurality of separate fluid chambers positioned around a perimeter. The chambers define an open central portion of the bladder arrangement. Each of the chambers has an inner side, an outer side and a height that increases from a minimum adjacent the inner side to a maximum toward the outer side thereof.

15 Claims, 2 Drawing Sheets

CUSHIONING DEVICE FOR AN ATHLETIC SHOE

CROSS-REFERENCE TO RELATED APPLICATION

This application claims the benefit of U.S. Provisional Application No. 60/226,451 filed Aug. 17, 2000.

FIELD OF THE INVENTION

The present invention relates to a cushioning device for an athletic shoe and, more particularly, to such a cushioning device that imparts both stability and cushioning to the midsole of an athletic shoe.

BACKGROUND OF THE INVENTION

Athletic shoes typically include supporting and cushioning structures to absorb the force of impact associated with running and jumping. The supporting and cushioning structures are often positioned in the rear foot or heel section of the shoe in order to absorb a portion of the shock encountered by the wearer. Such structures may be designed to increase the stability of the shoe by supporting the wearer's foot against undesirable rotation relative to the leg. Pronation, rotation of the inner, or medial, side of the foot downward relative to the outer, or lateral side, and supination, the opposite rotation of the medial side upward relative to the lateral side, are two types of excessive rotation that can cause foot injury. These rotations are prevented or alleviated by the structures that resist the rotational motion of the foot.

Fluid bladders are one type of structure used to provide cushioning and stabilizing in athletic shoes. Bladders of this type include fluid filled chambers or pockets that are fitted in the midsole of the athletic shoe. The pockets may be pressurized beyond the ambient pressure level, or may be filled with fluid at the ambient pressure. U.S. Pat. No. 5,575,088 discloses a fluid bladder imparting cushioning to a heel section of a shoe. The bladder includes individual, concentric chambers that are connected so as to allow fluid to be communicated between the chambers. The concentric chambers are ring shaped with the inner ring having a lower height than the outer ring. The arrangement forms a cradle for the heel, providing support and stabilization therefor. The pressure within the chambers of the bladder is uniform because fluid pressure equilibrates between the ring sections, which are in fluid communication with one another. U.S. Pat. No. 5,353,459 discloses a bladder in which separate chambers are maintained at different pressures through the use of distinct interconnecting tubes.

SUMMARY OF THE INVENTION

The present invention improves upon the cushioning and stabilizing characteristics of existing bladder arrangements. The bladder arrangement of the present invention includes a plurality of separate, fluid filled chambers positioned around a perimeter. The chambers are positioned so that an area having the greatest volume is located towards the outer side thereof. The individual chambers may be connected to one another by connective elements, but are not in fluid communication with one another. Under angled impact by a wearer's heel, the fluid filled chambers absorb the force of impact. The higher volume section of one or more of the chambers is subjected to compressive forces first. The loading of the higher volume section forces pressure into the lower volume section(s) thereby providing an increasingly greater resistance as the higher volume section is further compressed. The building of resistance provides a gradual reduction of the impact forces encountered by the wearer as the higher volume section(s) deflects.

In a preferred embodiment of the invention, the bladder arrangement includes a rear central chamber, a first side (medial) chamber and a second side (lateral) chamber. The fluid pressure of the medial chamber is maintained at a higher pressure than the fluid pressure in the other chambers in the arrangement. The higher fluid pressure provides increased stiffness of the medial chamber and provides added protection against pronation.

The fluid bladder is preferably encapsulated by a cushioning material such as polyurethane foam. The encapsulated fluid filled bladder arrangement, that comprises the cushioning device, is positioned in the space in the rear foot region of the shoe midsole.

DETAILED DESCRIPTION OF THE INVENTION

Figure 1:
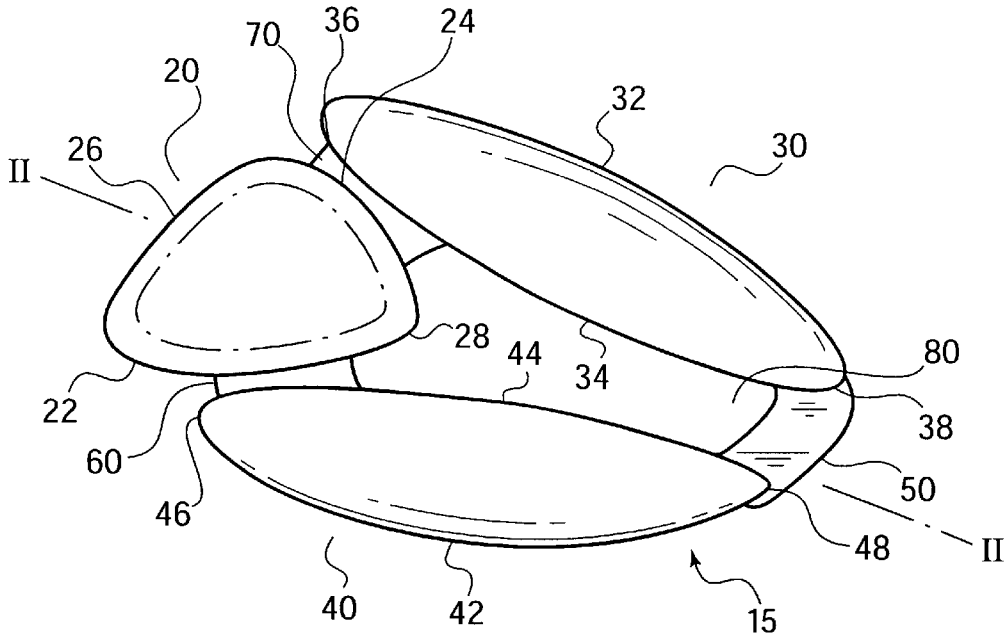
FIG. 1 is a perspective view of the fluid bladder arrangement according to an embodiment of the invention.

Referring now to the drawings in detail wherein like reference numerals have been used throughout the figures to designate like elements, there is shown in FIG. 1 a preferred bladder arrangement designed to impart both cushioning and stability to a wearer's foot. The bladder arrangement 15 includes a number of individually sealed chambers 20, 30 and 40 that are filled with a pressurized fluid. A preferred fluid is nitrogen gas ($N_2$). Various other gasses may be utilized such as air, hexafluorethane or sulfur hexafluoride. Other suitable gases include those disclosed in U.S. Pat. No. 4,183,156, which is incorporated herein by reference. The gas selected should have a low diffusion rate through the walls of the bladder arrangement to ensure that a desirable useful life of the cushioning device may be achieved. It is also noted that a liquid, gel or polymeric foam could be utilized as the fluid.

The walls of the chambers preferably are comprised of an elastomeric material such as a thermoplastic polyurethane elastomer (TPU). Other suitable materials include, by way of non-limiting example, polyester, poly(ethylene-co-vinyl acetate) (EVA), polyethylene, propylene, neoprene and rubber. Materials that have been found to be particularly useful in the manufacture of the bladder arrangement of the present invention are materials with a shore "A" durometer hardness in the range of approximately 85 to approximately 95 and, more preferably, in the range of 87 to 93. The walls of the chambers preferably are from approximately 0.5 mm to approximately 2.5 mm thick. The chambers may be manufactured by various methods known in the art such as a two-film technique or blow-molding.

In a preferred embodiment, the bladder arrangement includes a rear central chamber 20, a first side (medial chamber) 30 and a second side (lateral) chamber 40. FIG. 1. However, a greater number of chambers may be utilized in accordance with the spirit of the invention, and the specific number should not be taken as limiting. Chambers 20, 30 and 40 are preferably arranged in a "horseshoe" configuration to provide a cushioned landing surface for the heel of a wearer as more fully described below. Chambers 20, 30 and 40 define an open, central portion 80. This configuration facilitates the positioning of the wearer's heel, upon impact, to the central area of the bladder arrangement where it is stabilized and cushioned.

As shown in FIG. 1, rear central chamber 20 preferably has a substantially conic shape, with opposing lateral sides 22, 24, an outer side 26, and an inner side 28. Rear central chamber reaches a maximum height toward the outer side 26 thereof. Accordingly, the volume of chamber 20 increases from a point of minimum volume adjacent inner side 28 to a point of maximum volume adjacent outer side 26. The rear central chamber preferably has a height of about 15 to about 20 mm, a width of about 30 mm to about 35 mm, and a length of about 25 to about 30 mm.

Figure 2:
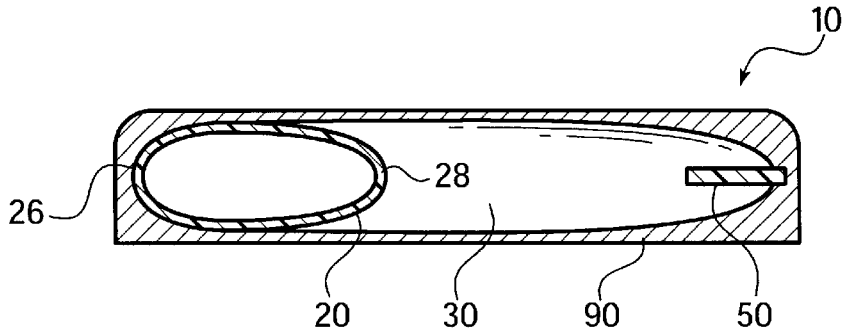
FIG. 2 is a cross-sectional view of the present invention taken along lines 2—2 of FIG. 1.

Fluid filled, medial chamber 30 also includes an outer side 32, an inner side 34, a rear end section 36 and a front end section 38. Again, as shown in FIG. 1, the medial chamber reaches a maximum height toward the outer side 32 thereof and, therefore, the volume of chamber 30 increases from a point of minimum volume adjacent inner side 34 to a point of maximum volume adjacent outer side 32. In FIG. 2, which shows a section of the bladder arrangement along lines 2—2 of FIG. 1, the relative dimensions of the medial and central chambers are displayed. The preferred dimensions, which are dependant shoe size, for the medial chamber 30 are as follows: a height of from about 15 mm to about 20 mm, a length of from about 50 mm to 70 mm and a width of from about 20 mm to about 25 mm. In the preferred embodiment, inner and outer sides of the medial chamber 30 are convex.

Fluid filled, lateral chamber 40, which lies opposite the medial chamber 30 across the central portion 80 of the cushioning device, preferably has dimensions substantially equivalent to the medial chamber. Lateral chamber 40 includes an outer side 42, an inner side 44, a rear end section 46 and a front end section 48. As with medial chamber 30, the lateral chamber reaches a maximum height toward the outer side 42. Accordingly, the volume of chamber 40 increases from a point of minimum volume adjacent inner side 44 to a point of maximum volume adjacent outer side 42.

The separate chambers may be connected by connective elements 50, 60 and 70. FIG. 1. Connective elements are preferably comprised of the same material as the chamber walls. The rear end section of 36 of the medial chamber 30 is connected to lateral side 24 of the rear central chamber 20 by connective element 70 while the rear end section 46 of the lateral chamber 40 is connected to the lateral side 22 of chamber 20 by connective element 60. Accordingly, the medial chamber 30 extends forwardly from the lateral side 24 of the rear central chamber. Similarly, lateral chamber 40 extends forwardly from the lateral side 22 of the rear central chamber. The connective elements facilitate the molding of the bladder arrangement. Further, the connective elements facilitate the positioning of the bladder arrangement within the shoe or the encapsulation of the bladder arrangement as discussed below.

In a preferred embodiment of the invention, the fluid pressure of the medial chamber 30 is greater than the fluid pressure of the other chambers 20, 40 in order to increase the stiffness of the same. The raised pressure level is set during the manufacture of the chambers. The preferred pressure levels for the lateral and rear central chambers are from about 8 psi to about 10 psi. The preferred pressure level for the medial chamber is from about 11 psi to 13 psi. The increased stiffness of the medial chamber 30 increases resistance to rotation of the medial side of the foot and thereby provides extra protection against excessive pronation.

Figure 3:
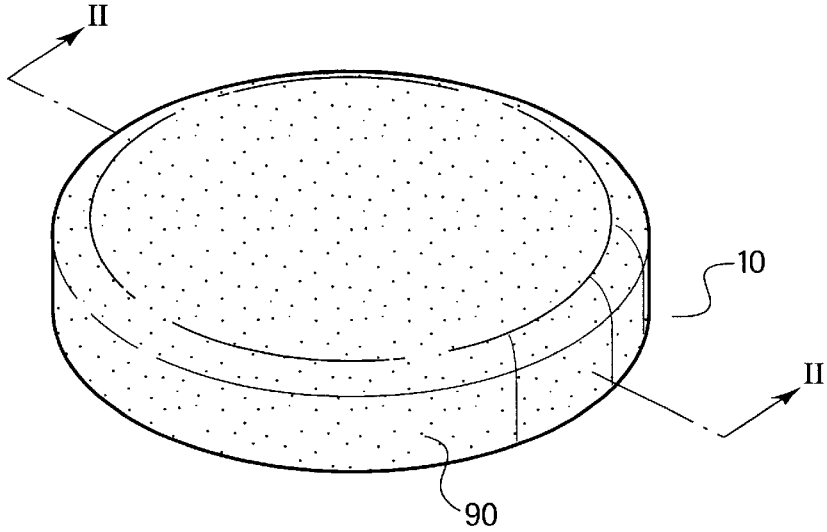
FIG. 3 is a perspective view of the cushioning device.

In FIG. 3, the cushioning device is shown encapsulated within a layer of an elastomeric material 90 in order to provide increased cushioning directly under the heel of the wearer. The preferred thickness and other characteristics of the encapsulation layer 90 are dependant on a number of variables such as the pressure within each of the chambers to be encapsulated, the wall thickness of the chambers, the hardness of the chamber wall material, etc. It is also noted that the cushioning device may be either partially encapsulated or not encapsulated at all. In a preferred embodiment, the layer of elastomeric material fills the open central portion 80 of the bladder arrangement 15.

A preferred material for the encapsulation layer 90 is polyurethane foam. However, various other elastomeric materials may be used to encapsulate the cushioning device. Other materials include, by way of non-limiting example, polyester, polyvinyl chloride, neoprene, polyethylene, and rubber. In addition to absorbing the force of the initial impact, the layer of elastomeric material 90 foam absorbs the residual impact forces arising when the chambers 20, 30 and 40 of the bladder 15 have been deformed. The encapsulation layer 90 is designed to have desirable cushioning and recovery properties.

The foregoing features provide stabilization by providing resistance against rotational movements of the wearer's foot relative his or her leg. When such rotational movements occur, the foot exerts angled pressure on one or more of the fluid chambers 20, 30, 40. Under angled impact by a wearer's heel, the fluid filled chambers absorb the impact force. The higher volume section of one (or more) of the chambers is subjected to compressive forces first. The loading of the higher volume section forces pressure into the lower volume section(s) thereby providing an increasingly greater resistance as the higher volume section is further compressed. The building of resistance provides a gradual reduction of the impact forces encountered by the wearer as the higher volume section(s) deflects. The impact forces cause the stiffening of the chambers, which then resist the continued motion of the foot.

The cushioning device 10, comprising both the bladder arrangement 15 and the encapsulation layer 90, may be configured to create a convex dome between the wearer's heel and the ground. Upon impact, the cushioning device is compressed and is deformed without having any deleterious impact force applied directly from the ground to the heel. Under vertical impact, the cushioning device absorbs force through structural deformation. Under angled impact, as discussed above, the heel of the wearer exerts pressure on a higher volume section of one (or more) of the chambers and fluid is forced into the lower volume section of such chamber. The compression of the chamber serves to absorb the potentially damaging impact forces that would otherwise be imparted to the wearer's heel. Further, the configuration of the bladder arrangement facilitates the positioning of the heel back toward the central portion of the cushioning device 10. This sequence stabilizes and cushions the heel of the wearer.

Figure 4:
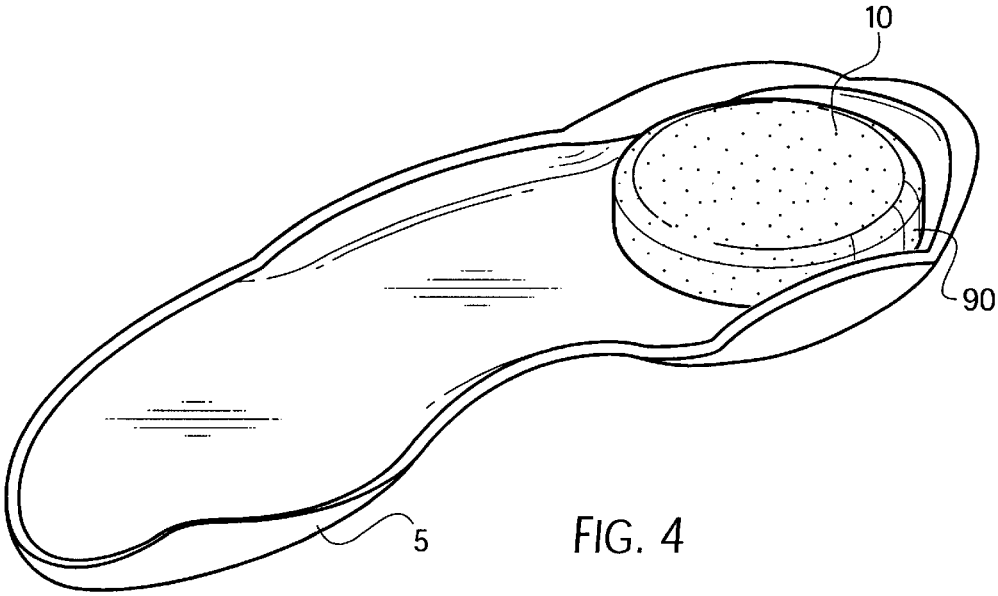
FIG. 4 is a perspective view of the cushioning device positioned on a shoe midsole.

In FIG. 4, the composite cushioning device 10 is shown positioned at the heel of a midsole 5. The cushioning device 10 may be incorporated directly into the midsole during manufacturing or it may be a supplemental component, added or removed from the athletic shoe at a different point in the shoe assembly process.

In the foregoing description, the device of the invention has been described with reference to a preferred embodiment that is not to be considered limiting. Rather, it is to be understood and expected that variations in the principles of the device herein disclosed may be made by one skilled in the art and it is intended that such modifications, changes, and/or substitutions are to be included within the scope of the present invention as set forth in the appended claims. For example, in alternative implementations, the fluid pressure in chambers other than the medial chamber may maintained above the level in other chambers in order to protect against certain types of motion such as supination, as the case may be. Further, additional chambers may form the cradle of the bladder 15. The specification and the drawings are accordingly to be regarded in an illustrative rather than in a restrictive sense and reference should be made to the claims rather than to the foregoing specification as indicating the scope thereof.

What is claimed is:

1. A cushioning device for a shoe comprising:

a bladder arrangement including a plurality of distinct chambers filled with fluid, the chambers defining an open central portion of the bladder arrangement, each of the chambers having an inner side and an outer side, each of the chambers having a height that increases from a minimum adjacent the inner side to a maximum toward the outer side thereof, wherein the chambers are not in fluid communication with each other.

2. The cushioning device of claim 1 wherein each of the chambers is comprised of a material selected from the group consisting of thermoplastic polyurethane elastomer, polyester, poly(ethylene-co-vinyl acetate), polyethylene, propylene, neoprene and rubber.

3. The cushioning device of claim 1 wherein the fluid filled bladder is at least partially encapsulated with a layer of elastomeric material.

4. The cushioning device of claim 3 wherein the layer of elastomeric material fills the open central portion of the bladder arrangement.

5. The cushioning device of claim 3 wherein the layer of elastomeric material is comprised of a member selected from the group consisting of polyurethane, polyester, polyvinyl chloride, neoprene, polyethylene, and rubber.

6. The cushioning device of claim 1, wherein the bladder arrangement includes a rear central chamber, a medial chamber and a lateral chamber, the medial chamber extends forwardly from one side of the rear central chamber and the lateral chamber extends forwardly from an opposite side of the rear central chamber.

7. The cushioning device of claim 6 wherein the rear central chamber has a conic shape.

8. The cushioning device of claim 6 wherein the medial chamber and the lateral chamber have substantially equivalent dimensions.

9. The cushioning device of claim 6 wherein the medial and lateral chambers each includes a pair of opposing convex sides.

10. The cushioning device of claim 6, wherein the fluid within each of the chambers is pressurized.

11. The cushioning device of claim 10, wherein the fluid within one of the chambers is pressurized to a higher pressure than at least one of the other chambers.

12. The cushioning of claim 10, wherein the fluid within medial chamber is pressurized to a higher pressure than at least one of the rear central chamber and the lateral chamber.

13. The cushioning device of claim 10, wherein the fluid is selected from the group consisting of nitrogen, air, hexafluorethane and sulfur hexafluoride.

14. The cushioning device of claim 1 wherein each of the chambers has a thickness of approximately 0.5 mm to approximately 2.5 mm.

15. The cushioning device of claim 1 wherein the bladder arrangement has a horseshoe configuration.

* * * * *